US012297599B2

(12) United States Patent
Wallace et al.

(10) Patent No.: US 12,297,599 B2
(45) Date of Patent: May 13, 2025

(54) PROCESS AND SYSTEM FOR REORIENTING FIBERS IN A FOAM FORMING PROCESS

(71) Applicants: Kimberly-Clark Worldwide, Inc., Neenah, WI (US); Peter Wallace, Penzance (GB); Joseph K. Baker, Cumming, GA (US); Charles W. Colman, Marietta, GA (US)

(72) Inventors: Peter Wallace, Penzance (GB); Joseph K. Baker, Cumming, GA (US); Charles W. Colman, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/560,690

(22) PCT Filed: Jun. 27, 2022

(86) PCT No.: PCT/US2022/035052
§ 371 (c)(1),
(2) Date: Nov. 14, 2023

(87) PCT Pub. No.: WO2022/272159
PCT Pub. Date: Dec. 29, 2022

(65) Prior Publication Data

US 2024/0254695 A1 Aug. 1, 2024

Related U.S. Application Data

(60) Provisional application No. 63/215,494, filed on Jun. 27, 2021, provisional application No. 63/215,128, filed on Jun. 25, 2021.

(51) Int. Cl.
*D21H 21/56* (2006.01)
*D21F 1/02* (2006.01)
*D21F 11/00* (2006.01)

(52) U.S. Cl.
CPC ..... *D21H 21/56* (2013.01); *D21F 1/026* (2013.01); *D21F 11/002* (2013.01)

(58) Field of Classification Search
CPC ..... D21F 1/026; D21F 1/02; D21H 21/56
See application file for complete search history.

(56) References Cited

U.S. PATENT DOCUMENTS 3,907,635 A * 9/1975 Bringman ..... D21F 9/02 162/347
4,133,713 A 1/1979 Chuang
(Continued)

FOREIGN PATENT DOCUMENTS

DE 102009001731 A1 9/2010
EP 0837966 B1 2/2003
(Continued)

OTHER PUBLICATIONS

PCT Search Report Corresponding to Application No. PCT/US2022/035052 on Oct. 18, 2022.
(Continued)

*Primary Examiner* — Jose A Fortuna
(74) *Attorney, Agent, or Firm* — Dority & Manning, P.A.

(57) ABSTRACT

A process for foam forming webs is described herein. A foamed suspension of fibers is fed into a mixing chamber and then directed through a narrow constriction where the velocity of the foamed suspension of fibers is increased. From the narrow constriction, the foamed suspension of fibers enters a forming chamber which causes the foamed suspension of fibers to rapidly decrease in velocity. In one embodiment, for example, the foamed suspension of fibers
(Continued)

undergoes a hydraulic jump resulting in significant fiber reorientation. Through the process, fiber orientation can be controlled. For example, webs can be produced that have comparable fiber orientation in the machine direction in comparison to the cross-machine direction.

22 Claims, 5 Drawing Sheets

(56) References Cited

U.S. PATENT DOCUMENTS 4,443,297 A * 4/1984 Cheshire ..... D21F 11/002 162/190
4,543,156 A * 9/1985 Cheshire ..... D21F 9/003 162/190
5,011,573 A * 4/1991 Niemi ..... D21G 9/0009 162/263
5,429,686 A 7/1995 Chiu et al.
5,472,571 A * 12/1995 Niemi ..... D21G 9/0009 162/DIG. 11
5,529,665 A 6/1996 Kaun
5,552,021 A 9/1996 Ilvespääet al.
5,672,248 A 9/1997 Wendt et al.
5,688,372 A 11/1997 Huovila et al.
6,053,040 A * 4/2000 Callender ..... D21G 9/0027 73/159
6,500,302 B2 * 12/2002 Dwiggins ..... D21F 11/002 162/190
6,524,441 B2 2/2003 Ruf et al.
7,318,882 B2 * 1/2008 Niemi ..... D21G 9/0027 162/263
7,578,906 B2 8/2009 Shands et al.
10,519,606 B2 * 12/2019 Swails ..... D21H 27/002
11,085,151 B2 * 8/2021 Mustonen ..... D21H 13/16
11,091,879 B2 * 8/2021 Swails ..... D21H 21/56
11,920,299 B2 * 3/2024 Forester ..... D21F 5/04
11,932,988 B2 * 3/2024 Swails ..... D21F 1/66
2002/0195215 A1 12/2002 Holz et al.
2006/0005934 A1 1/2006 Graef et al.
2008/0093042 A1 4/2008 Skoog et al.
2011/0290442 A1 * 12/2011 Wildfong ..... D21F 1/483 162/344
2013/0009335 A1 1/2013 Guimond et al.
2015/0238650 A1 * 8/2015 Lu ..... B01J 20/267 252/194
2020/0123710 A1 * 4/2020 Swails ..... D21F 1/009
2020/0370246 A1 * 11/2020 Calewarts ..... D04H 1/593

FOREIGN PATENT DOCUMENTS

EP 1619298 A2 1/2006
EP 1479819 B1 * 7/2011 ..... D21F 1/483
KR 20240023640 A * 2/2024 ..... D21H 21/56
WO WO1999022059 A1 5/1999

OTHER PUBLICATIONS

Endres et al., Prospects of wet-laid nonwovens for organosheet-products, , 2017, pp. 1-4, https://doi.org/10.1016/j..repl.2017.07.002.

* cited by examiner

PROCESS AND SYSTEM FOR REORIENTING FIBERS IN A FOAM FORMING PROCESS

RELATED APPLICATIONS

The present application is the national stage entry of International Patent Application No. PCT/US2022/035052 having a filing date of Jun. 27, 2022, Provisional Patent Application No. 63/215,494 having a filing date of Jun. 27, 2021, and Provisional Patent Application No. 63/215,128 having a filing date of Jun. 25, 2021, which are incorporated herein in their entirety by reference thereto.

BACKGROUND

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web.

In order to improve various characteristics of tissue webs, webs have also been formed according to a foam forming process. During a foam forming process, a foamed suspension of fibers is created and spread onto a moving porous conveyor for producing an embryonic web. Foam formed webs can demonstrate improvements in bulk, stretch, caliper, and/or absorbency.

In addition to tissue webs, foam forming can be used to make all different types of webs and products. For example, relatively long fibers and synthetic fibers can be incorporated into webs using a foam forming process. Thus, foam forming processes can be more versatile than many wet laid processes.

When forming webs according to a foam forming process, however, problems have been experienced in controlling the fiber orientation in the resulting web. During production of the web, for instance, the foam suspends the fibers and conveys the fibers downstream at a flow rate that demonstrates plug flow characteristics and/or a low yield stress. Consequently, many foam forming processes produce webs in which the fibers are primarily oriented in the machine direction of the webmaking process, especially when the foam formed webs are formed on an inclined surface.

Thus, a need currently exists for a system and process of producing foam formed webs in which there is control over the fiber orientation. In particular, a need exists for a process and system that can produce foam formed webs where the fiber orientation is more random and results in fibers being oriented in the machine direction and in the cross-machine direction. Producing webs with a more uniform fiber orientation distribution can provide various benefits and advantages. For instance, the webs can demonstrate a greater uniformity of physical properties between the machine direction of the web and the cross-machine direction of the web.

SUMMARY

In general, the present disclosure is directed to an improved process and system for forming webs from a foamed suspension of fibers. More particularly, the process and system of the present disclosure has been particularly designed in order to better control fiber orientation in webs made from the process. For example, webs made from the process can demonstrate a more random fiber orientation such that a greater amount of fibers are oriented in the machine direction. In one aspect, the amount of fibers oriented in the machine direction are proportional to or substantially equal to the amount of fibers oriented in the cross-machine direction.

Through the process of the present disclosure, webs can be produced with improved properties and characteristics. For example, the webs can display enhanced stretch characteristics in both the machine direction and the cross-machine direction. In addition, foam formed webs made according to the present disclosure can have a machine direction to cross-machine direction tensile strength ratio of from about 0.8 to about 1.8, such as from about 0.9 to about 1.6, such as from about 0.9 to about 1.4, such as from about 0.9 to about 1.2. In one particular embodiment, the web can have a machine direction to cross-machine direction tensile strength ratio of from about 1 to about 1.15.

Webs can be made with high bulk characteristics or low bulk characteristics. The webs, for example, can have a bulk of greater than about 3 cc/g, such as greater than about 5 cc/g, such as greater than about 7 cc/g, such as greater than about 9 cc/g, such as greater than about 11 cc/g, such as greater than 14 cc/g and generally less than about 20 cc/g. Alternatively, the webs can have a bulk of less than about 3 cc/g, such as less than about 1 cc/g, such as less than about 0.5 cc/g, such as less than about 0.08 cc/g, and generally greater than about 0.03 cc/g.

Webs made according to the present disclosure can have all different types of basis weights. For instance, the basis weight can be from about 6 gsm to about 800 gsm, such as from about 10 gsm to about 200 gsm, such as from about 20 gsm to about 120 gsm. The webs can be made exclusively from pulp fibers or can be made from pulp fibers blended with other fibers, such as synthetic fibers and/or superabsorbent particles or fibers. Alternatively, the webs can be made exclusively from synthetic polymer fibers, from regenerated cellulose fibers, or from mixtures thereof. In one aspect, the synthetic fibers, for instance, can be present in the nonwoven web in an amount greater than about 5% by weight, such as in an amount greater than about 15% by weight, such as greater than about 20% by weight, such as in an amount greater than about 25% by weight, and in an amount up to 100% by weight. The synthetic fibers can comprise polymer fibers, such as polyester fibers. Alternatively, the synthetic fibers can comprise regenerated cellulose fibers, such as rayon fibers, viscose fibers, and the like.

In order to produce webs as described above, in one embodiment, the process includes depositing a foamed suspension of fibers into a mixing chamber. In one aspect, the foamed suspension of fibers can be injected into the mixing chamber in at least one direction and possibly in two different directions. For example, the foamed suspension of fibers can be injected into the mixing chamber in a vertical direction and in a horizontal direction. In one embodiment, the foamed suspension of fibers is injected into the mixing chamber from a top of the mixing chamber and from a side of the mixing chamber. The foamed suspension can enter the mixing chamber at a velocity of greater than about 1 m/sec, such as greater than about 1.5 m/sec, such as greater than about 2 m/sec, such as greater than about 2.5 m/sec, and less than about 6 m/sec, such as less than about 5 m/sec, such as less than about 4 m/sec.

The process further includes the step of flowing the foamed suspension of fibers from the mixing chamber through a narrow constriction and into a forming zone. For example, the mixing chamber can be enclosed except for the narrow constriction. The narrow constriction can comprise a slot that extends along the width of the mixing chamber at the bottom. The slot can cause the foamed suspension of fibers to reach super-critical flow. The foamed suspension of fibers moves through the narrow constriction at a fluid flow rate such that the foamed suspension of fibers undergoes turbulent flow within the forming zone. For example, the foamed suspension of fibers can undergo a hydraulic jump that forms eddies in the foam and causes better fiber mixing.

The foamed suspension of fibers is conveyed through the forming zone on a moving forming surface. The foamed suspension of fibers is drained of fluids through the forming surface within the forming zone to form an embryonic web. In one aspect, the velocity of the moving forming surface is controlled in relation to the velocity of the foamed suspension of fibers moving in the machine direction. For example, a ratio of the foamed suspension of fibers velocity to the forming surface velocity during draining of the foamed suspension of fibers in the forming zone can be from about 1:0.5 to about 1:2, such as from about 1:0.8 to about 1:1.8.

In addition to controlling the velocity of the moving forming surface in relation to the velocity of the foamed suspension of fibers, drainage of the foamed suspension of fibers can be also controlled in order to preserve fiber orientation that occurs due to the mixing of the fibers. For example, the forming zone can have a length and wherein the foamed suspension of fibers can have a drainage profile over the length of the forming zone. In one aspect, greater than about 50%, such as greater than about 60%, such as greater than about 70% of drainage of the foamed suspension of fibers occurs over an initial 33% of the length of the forming zone. In one aspect, the forming surface can be inclined in relation to a horizontal.

The foamed suspension of fibers can be formed according to the present disclosure by combining a foam with a fiber furnish. The foam can have a density of from about 200 g/L to about 600 g/L, such as from about 250 g/L to about 400 g/L. The foamed suspension can be formed by combining a foaming agent with water. The foamed fiber suspension in the mixing chamber can contain from about 40% to about 65% by volume air.

The present disclosure is also directed to a system for producing nonwoven webs. The system includes an enclosed mixing chamber for receiving a foamed suspension of fibers. The enclosed mixing chamber includes a top, a bottom, and at least one side wall. The mixing chamber has a height and a width. The mixing chamber further comprises a front slice wall that terminates a distance from the bottom of the mixing chamber forming a narrow constriction. Once a foamed suspension of fibers is deposited into the mixing chamber and mixed, the foamed suspension of fibers is directed out of the mixing chamber through the narrow constriction.

The system further includes a moving forming surface in operative association with the mixing chamber. The forming surface moves in a machine direction and receives the foamed suspension of fibers from the mixing chamber for conveying the foamed suspension of fibers downstream. Adjacent to the narrow constriction of the mixing chamber is positioned a forming zone. The forming zone has a length that is defined by the moving forming surface. The forming zone further includes a top forming surface positioned from the moving forming surface. In one embodiment, the forming zone has a gradually decreasing height in the machine direction over the length of the forming zone. A foamed suspension of fibers conveyed through the narrow constriction of the mixing chamber undergoes a hydraulic jump that can cause turbulent flow of the foamed suspension and better mixing of the fibers. The system further includes a drying device positioned downstream from the forming zone for drying a web formed in the forming zone. The drying device, for instance, can be a through-air dryer or one or more heated drying drums.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
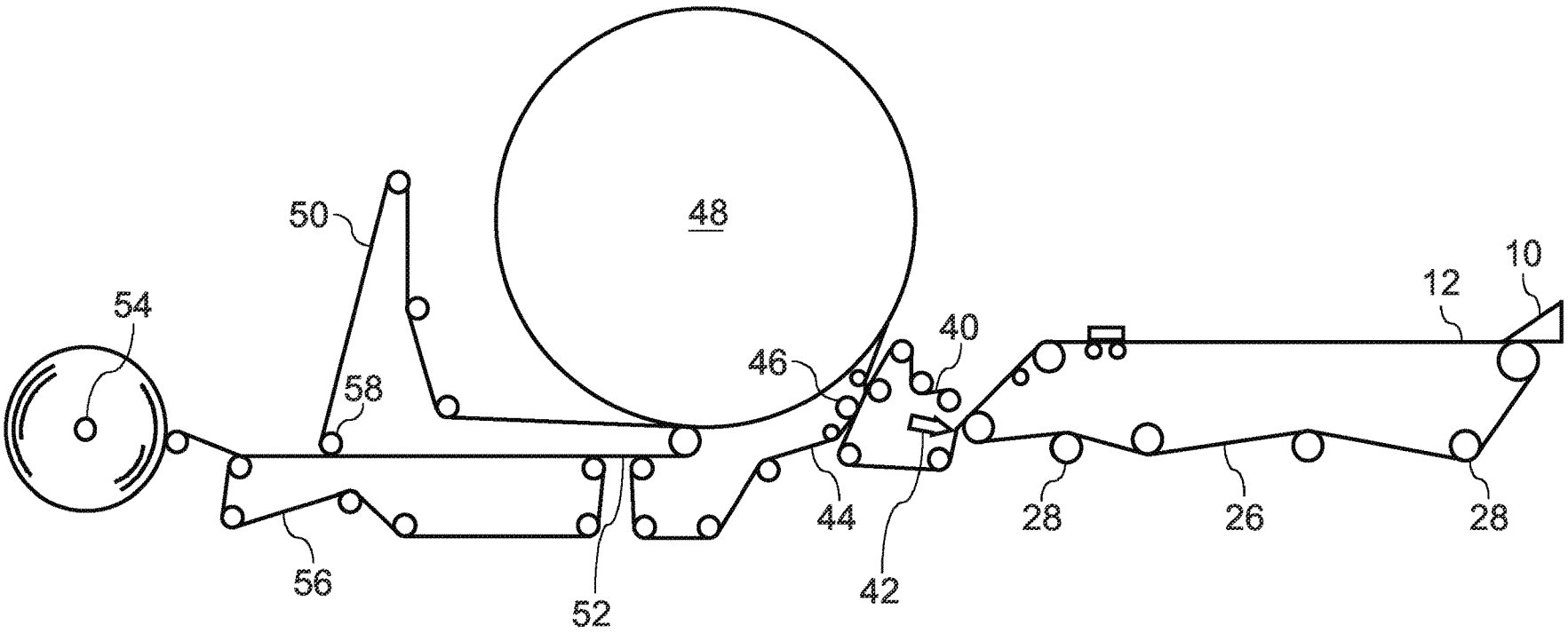
FIG. 1 is a schematic diagram of one embodiment of a process in accordance with the present disclosure for forming webs from a foamed suspension of fibers.

Repeat use of reference characters in the present specification and drawings is intended to represent the same or analogous features or elements of the present invention.

Definitions

The term "machine direction" as used herein refers to the direction of travel of the forming surface onto which fibers are deposited during formation of a nonwoven web.

The term "cross-machine direction" as used herein refers to the direction which is perpendicular to the machine direction defined above.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute, hemp, and bagasse. Pulp fibers can include hardwood fibers, softwood fibers, and mixtures thereof.

The term "average fiber length" as used herein refers to an average length of fibers, fiber bundles and/or fiber-like materials determined by measurement utilizing microscopic techniques. A sample of at least 20 randomly selected fibers is separated from a liquid suspension of fibers. The fibers are set up on a microscope slide prepared to suspend the fibers in water. A tinting dye is added to the suspended fibers to color cellulose-containing fibers so they may be distinguished or separated from synthetic fibers. The slide is placed under a Fisher Stereomaster II Microscope-S19642/S19643 Series. Measurements of 20 fibers in the sample are made at 20× linear magnification utilizing a 0-20 mils scale and an average length, minimum and maximum length, and a deviation or coefficient of variation are calculated. In some cases, the average fiber length will be calculated as a weighted average length of fibers (e.g., fibers, fiber bundles, fiber-like materials) determined by equipment such as, for example, a Kajaani fiber analyzer Model No. FS-200, available from Kajaani Oy Electronics, Kajaani, Finland. According to a standard test procedure, a sample is treated with a macerating liquid to ensure that no fiber bundles or shives are present. Each sample is disintegrated into hot water and diluted to an approximately 0.001% suspension. Individual test samples are drawn in approximately 50 to 100 ml portions from the dilute suspension when tested using the standard Kajaani fiber analysis test procedure. The weighted average fiber length may be an arithmetic average, a length weighted average or a weight weighted average and may be expressed by the following equation:

$$\sum_{x_i=0}^{k}(x_i * n_i)/n$$

where k=maximum fiber length $x_i$=fiber length $n_i$=number of fibers having length $x_i$ n=total number of fibers measured.

One characteristic of the average fiber length data measured by the Kajaani fiber analyzer is that it does not discriminate between different types of fibers. Thus, the average length represents an average based on lengths of all different types, if any, of fibers in the sample.

As used herein the term "staple fibers" means discontinuous fibers made from synthetic polymers such as polypropylene, polyester, post consumer recycle (PCR) fibers, polyester, nylon, regenerated cellulose fibers (e.g., rayon, viscose, lyocell, modal, etc.) and the like, and those not hydrophilic may be treated to be hydrophilic. Staple fibers may be cut fibers or the like. Staple fibers can have cross-sections that are round, bicomponent, multicomponent, shaped, hollow, or the like.

As used herein, dry strength or dry tensile strength is measured using a tensile test. The test is performed against samples that have been conditioned at 23° C.±1° C. and 50%±2% relative humidity for a minimum of 4 hours. The samples are cut into three-inch by six-inch samples using a precision sample cutter model JDC 15M-10, available from Thwing-Albert Instruments, located in Philadelphia, PA.

The gauge length of the tensile frame is set to 4 inches. The tensile frame is an Alliance RT/1 frame run with TestWorks 4 software. The tensile frame and the software are available from MTS Systems Corporation, located in Minneapolis, MN.

A sample is placed in the jaws of the tensile frame and subjected to a strain applied at a rate of 25.4 cm per minute until the point of sample failure. The stress on the sample is monitored as a function of the strain. The calculated outputs include the peak load (grams-force/3 inches, measured in grams-force), the peak stretch (%, calculated by dividing the elongation of the sample by the original length of the sample and multiplying by 100%), the percent stretch at 500 grams-force, the tensile energy absorption (TEA) at break (grams-force*cm/cm$^2$, calculated by integrating or taking the area under the stress-strain curve up to the point of failure where the load falls to 30% of its peak value), and the slope A (kilograms-force, measured as the slope of the stress-strain curve from 57-150 grams-force).

A product is measured using five replicate samples. The product is tested in the machine direction and the cross-machine direction.

Wet strength or wet tensile strength is measured in the same manner as dry strength except that the samples are wetted prior to testing. Specifically, in order to wet a sample, a 3 inch×5 inch tray is filled with distilled or deionized water at a temperature of 23° C.±2° C. The water is added to the tray to an approximate 1 cm depth.

A 3M "Scotch-Brite" general purpose scrubbing pad is cut to dimensions of 2.5 inches by 4 inches. A piece of masking tape approximately 5 inches long is placed along one of the four inch edges of the pad. The masking tape is used to hold the scrubbing pad.

The scrubbing pad is then placed in the water with the taped end facing up. The pad remains in the water at all times until testing is completed. The sample to be tested is placed on blotter paper that conforms to TAPPI T205. The scrubbing pad is removed from the water bath and tapped lightly three times on a screen associated with the wetting pan. The scrubbing pad is then gently placed on the sample parallel to the width of the sample in the approximate center. The scrubbing pad is held in place for approximately one second. The sample is then immediately put into the tensile tester and tested.

To calculate the wet/dry tensile strength ratio, the wet tensile strength value is divided by the dry tensile strength value.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a system and process for forming webs, including all different types of nonwoven webs including tissue webs, such as facial tissues, bath tissues, paper towels and the like; webs suitable for wiping products, including industrial wipers, pre-moistened wipers, and the like; and nonwoven webs for incorporation into absorbent articles such as diapers, adult incontinence products, feminine hygiene products, pull-ups, swim diapers, and the like. In accordance with the present disclosure, the webs are formed from a foamed suspension of fibers. The foamed suspension of fibers is deposited or injected into the web forming process according to a particular flow path that has been found to provide control over the orientation of the fibers that are used to form the web. In particular, the system and process of the present disclosure can be used to create webs having a more random fiber orientation that results in more uniformity in the amount of fibers that are oriented in the machine direction in comparison to the number of fibers that are oriented in the cross-machine direction. More random but uniform fiber orientation as described above results in webs having more uniform properties when comparing the physical properties of the web in the machine direction versus the physical properties of the web in the cross-machine direction.

As will be explained in greater detail below, the process and system of the present disclosure can also be used to control fiber orientation. For example, webs can be formed according to the present disclosure that have greater orientation in the machine direction or have greater orientation in the cross-machine direction depending upon the desired result. Consequently, the system and process of the present disclosure can also be used to produce webs having tailored properties for a particular end use application. For instance, through the process of the present disclosure, webs can be formed having improved stretch properties, improved absorbency characteristics, increased bulk if desired, increased caliper if desired, and/or increased basis weight. Additionally, a combination of different properties can be enhanced and improved.

There are many advantages and benefits to a foam forming process as described above. During a foam forming process, water is replaced with foam as the carrier for the fibers that form the web. The foam, which represents a large quantity of air, is blended with papermaking fibers. Since less water is used to form the web, less energy is required in order to dry the web.

According to the present disclosure, the foam forming process is combined with a unique fiber orientation and/or mixing process for producing webs having a desired balance of properties. The fiber orientation and/or mixing process can include first forming a foamed suspension of fibers and mixing the foamed suspension of fibers in a mixing chamber. The foamed suspension of fibers, for instance, can be injected into the mixing chamber that causes the fibers to mix and form a homogenous fiber distribution. The mixing chamber can be enclosed except for a narrow constriction. For example, the mixing chamber can include a front slice wall that forms a slot through which the foamed suspension of fibers is directed. More particularly, the foamed suspension of fibers flow through the narrow constriction at a super-critical flow rate and into an open and enlarged forming zone. Moving through the narrow constriction and into the forming zone causes the foamed suspension of fibers to increase in velocity or flow rate and then quickly decrease in velocity or flow rate that causes turbulent flow to occur and the creation of eddy currents. In this manner, the narrow constriction and forming zone cause the foamed suspension of fibers to undergo a hydraulic jump that further causes uniform and homogeneous mixing of the fibers, creating better fiber orientation in the cross-machine direction in comparison to the machine direction.

Once the foamed suspension of fibers undergoes turbulent flow within the forming zone, the foamed suspension of fibers is conveyed on a porous forming surface. One or more vacuum devices can be positioned below the forming surface for draining fluids from the aqueous suspension of fibers. In accordance with the present disclosure, at the point of the hydraulic jump of the foamed suspension of fibers, the foamed suspension is drained while the forming surface is moving at a controlled velocity in order to preserve the fiber orientation created in the forming zone for creating an embryonic web that is further fed downstream for further processing and drying. For example, during formation of the embryonic web, the velocity of the forming surface in relation to the velocity of the foamed suspension of fibers and the drainage profile of the foamed suspension of fibers are controlled in order to lock in the fiber orientation that is created during the hydraulic jump. For example, in one embodiment, the velocity of the moving forming surface is substantially matched with the velocity of the foamed suspension of fibers in the machine direction. In addition, individual drain boxes can be used such that most of the fluids are drained from the foamed suspension of fibers at the beginning of the forming surface. For example, the forming surface can have a length and greater than 50%, such as greater than about 60%, such as greater than about 70% of drainage of the fluids by volume or weight occur over the initial 33% of the length of the forming surface.

In forming nonwoven webs, which may include tissue or paper webs or nonwoven synthetic fiber webs, in accordance with the present disclosure, in one embodiment, a foam is first formed by combining water with a foaming agent. The foaming agent, for instance, may comprise any suitable surfactant. In one embodiment, for instance, the foaming agent may comprise sodium lauryl sulfate, which is also known as sodium laureth sulfate or sodium lauryl ether sulfate. Other foaming agents include sodium dodecyl sulfate or ammonium lauryl sulfate. In other embodiments, the foaming agent may comprise any suitable cationic and/or amphoteric surfactant. For instance, other foaming agents include fatty acid amines, amides, amine oxides, fatty acid quaternary compounds, and the like.

In one embodiment, a nonionic surfactant is used. The nonionic surfactant, for instance, may comprise an alkyl polyglycoside. In one aspect, for instance, the surfactant can be a C8 alkyl polyglycoside, a C10 alkyl polyglycoside, or a mixture of C8 and C10 alkyl polyglycosides.

The foaming agent is combined with water generally in an amount greater than about 0.1% by weight, such as in an amount greater than about 0.5% by weight, such as in an amount greater than about 0.7% by weight. One or more foaming agents are generally present in an amount of from about 0.01% by weight to about 5% by weight, such as in an amount up to about 2% by weight.

Once the foaming agent and water are combined, the mixture is blended or otherwise subjected to forces capable of forming a foam. A foam generally refers to a porous matrix, which is an aggregate of hollow cells or bubbles which may be interconnected to form channels or capillaries.

The foam density can vary depending upon the particular application and various factors including the fiber furnish used. In one embodiment, for instance, the foam density of the foam can be greater than about 200 g/L, such as greater than about 250 g/L, such as greater than about 300 g/L. The foam density is generally less than about 600 g/L, such as less than about 500 g/L, such as less than about 400 g/L, such as less than about 350 g/L. In one embodiment, for instance, a lower density foam is used having a foam density of generally less than about 350 g/L, such as less than about 340 g/L, such as less than about 330 g/L. The foam will generally have an air content of greater than about 40%, such as greater than about 50%, such as greater than about 60% (at STP). The air content is generally less than about 75% by volume, such as less than about 70% by volume, such as less than about 65% by volume.

The foam can be formed in the presence of a fiber furnish or, alternatively, the foam can first be formed and then combined with a fiber furnish. In general, any fibers capable of making a basesheet, such as a tissue web or other type of nonwoven web in accordance with the present disclosure may be used.

Fibers suitable for making webs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used.

A portion of the fibers, such as up to 100% or less by dry weight can be synthetic fibers. For example synthetic fibers can be present in the web in an amount greater than about 5% by weight, such as in an amount greater than 10% by weight, such as in an amount greater than 20% by weight, such as in an amount greater than 30% by weight, such as in an amount greater than 40% by weight, such as in an amount greater than 50% by weight, such as in an amount greater than 60% by weight, such as in an amount greater than 70% by weight, such as in an amount greater than 80% by weight, such as in an amount greater than 85% by weight, and in an amount less than about 100% by weight, such as in an amount less than about 90% by weight, such as in an amount less than about 80% by weight, such as in an amount less than about 70% by weight, such as in an amount less than about 60% by weight, such as in an amount less than about 50% by weight, such as in an amount less than about 40% by weight, such as in an amount less than about 30% by weight. In one aspect, synthetic fibers are present in the nonwoven web in an amount of from about 5% to about 70% by weight including all increments of 1% by weight therebetween, such as from 5% to about 30% by weight. Synthetic fibers include rayon fibers, polyolefin fibers, polyester fibers, bicomponent sheath-core fibers, multi-component binder fibers, and the like. The fibers can be virgin fibers or recycled fibers. The fibers can be staple fibers and can have an average length of from about 3 mm to about 150 mm. An exemplary polyethylene fiber is Fybrel®, available from Minifibers, Inc. (Jackson City, Tenn.). When containing synthetic polymer fibers, the web can be thermally bonded where the fibers intersect.

In one aspect, the nonwoven web can contain pulp fibers, such as softwood fibers, combined with polyester fibers. The polyester fibers can be staple fibers having a size of from about 0.5 denier to about 2.5 denier. The polyester fibers can be contained in the web in an amount of from about 5% by weight to about 50% by weight, such as from 10% by weight to about 40% by weight.

Synthetic cellulose fiber types include regenerated cellulose fibers, such as rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

The web can also be formed without a substantial amount of inner fiber-to-fiber bond strength. In this regard, the fiber furnish used to form the base web can be treated with a chemical debonding agent, especially when cellulose fibers are present. The debonding agent can be added to the foamed fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents. In one embodiment, the debonding agent used in the process of the present disclosure is an organic quaternary ammonium chloride and, particularly, a silicone-based amine salt of a quaternary ammonium chloride. For example, the debonding agent can be PROSOFT®. TQ1003, marketed by the Hercules Corporation. The debonding agent can be added to the fiber slurry in an amount of from about 1 kg per metric tonne to about 10 kg per metric tonne of fibers present within the slurry.

In an alternative embodiment, the debonding agent can be an imidazoline-based agent. The imidazoline-based debonding agent can be obtained, for instance, from the Witco Corporation. The imidazoline-based debonding agent can be added in an amount of between 2.0 to about 15 kg per metric tonne.

Other optional chemical additives may also be added to the aqueous papermaking furnish or to the formed embryonic web to impart additional benefits to the product and process. The following materials are included as examples of additional chemicals that may be applied to the web. The chemicals are included as examples and are not intended to limit the scope of the invention. Such chemicals may be added at any point in the papermaking process.

Additional types of chemicals that may be added to the paper web include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin E, silicone, lotions in general and the like may also be incorporated into the finished products.

In general, the products of the present disclosure can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles may also be employed. Additional options include cationic dyes, optical brighteners, humectants, emollients, and the like.

In order to form the web, the foam is combined with a selected fiber furnish in conjunction with any auxiliary agents. The foamed suspension of fibers can be pumped to a tank and from the tank is fed to a headbox. Alternatively, the foamed suspension can be pumped directly to or formed directly in the headbox without the use of an intervening tank. FIG. 1, for instance, shows one embodiment of a process in accordance with the present disclosure for forming a web. As shown particularly in FIG. 1, from a headbox 10, the foamed fiber suspension is issued from the headbox onto an endless traveling fabric 26 supported and driven by rolls 28 in order to support a wet embryonic web 12. The web 12 may comprise a single homogeneous layer of fibers or may include a stratified or layered construction. The system can include a single headbox or can include a plurality of headboxes that work in conjunction to create a nonwoven web.

Once the wet web is supported on the fabric 26, the web is conveyed downstream and further dewatered and dried.

Figure 2:
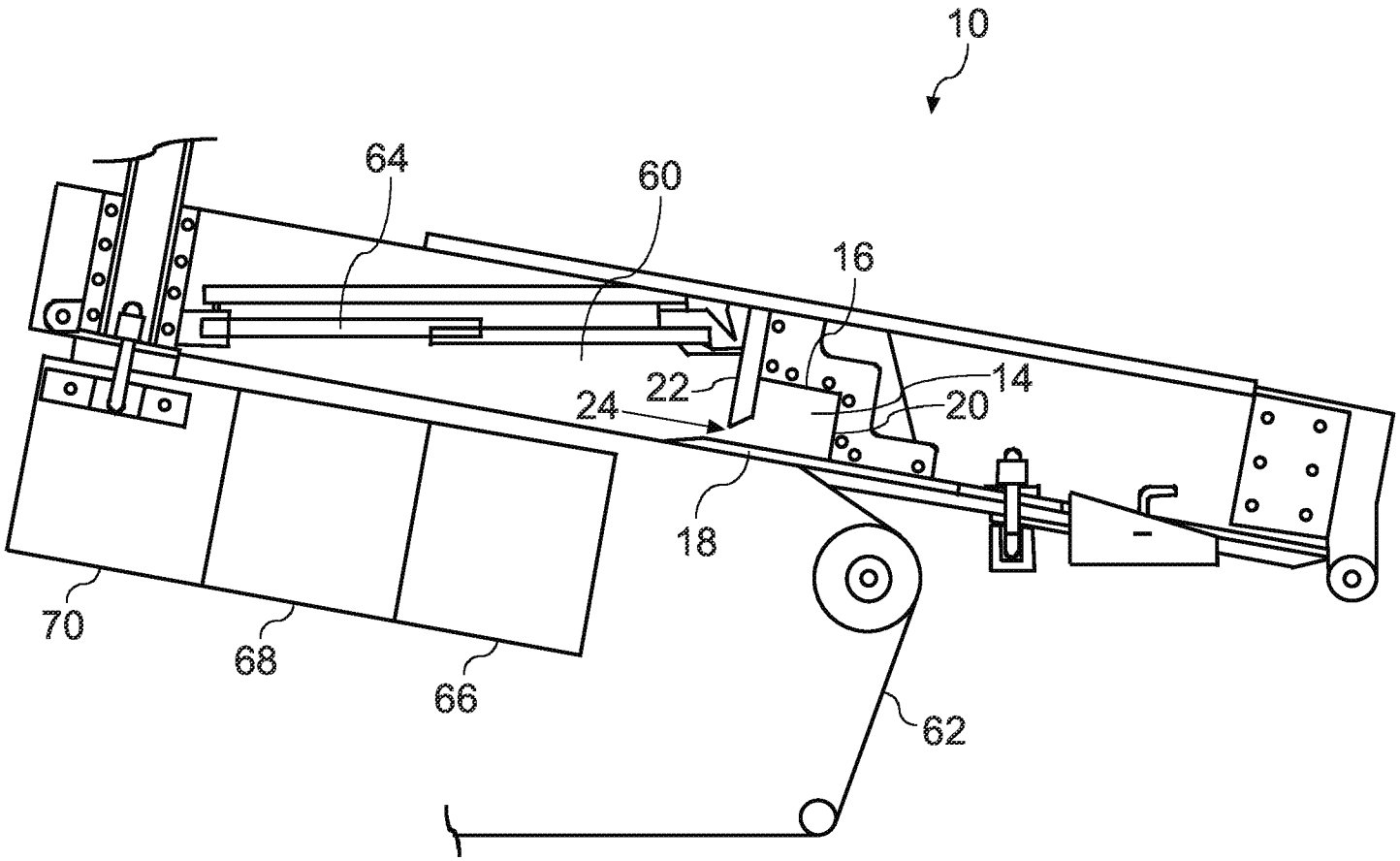
FIG. 2 is a cross-sectional view of a system and process for depositing a foamed suspension of fibers onto a forming surface in accordance with the present disclosure.

In accordance with the present disclosure, the foamed suspension of fibers undergoes mixing and turbulent flow in a manner that produces a web with a desired fiber orientation. In one aspect, for instance, fiber orientation can be controlled within the headbox 10. The headbox 10, for instance, is illustrated in greater detail in FIGS. 2 and 3. Referring to FIG. 2, for instance, the process of the present disclosure includes a mixing chamber 14 that is designed to receive the foamed suspension of fibers. In the embodiment illustrated in FIGS. 2 and 3, the mixing chamber 14 has a rectangular cross-sectional shape that extends over the width of the papermaking system. The mixing chamber 14, however, can have any suitable shape. For example, in other embodiments, the mixing chamber 14 may include curved surfaces that better enhance fiber mixing.

Figure 3:
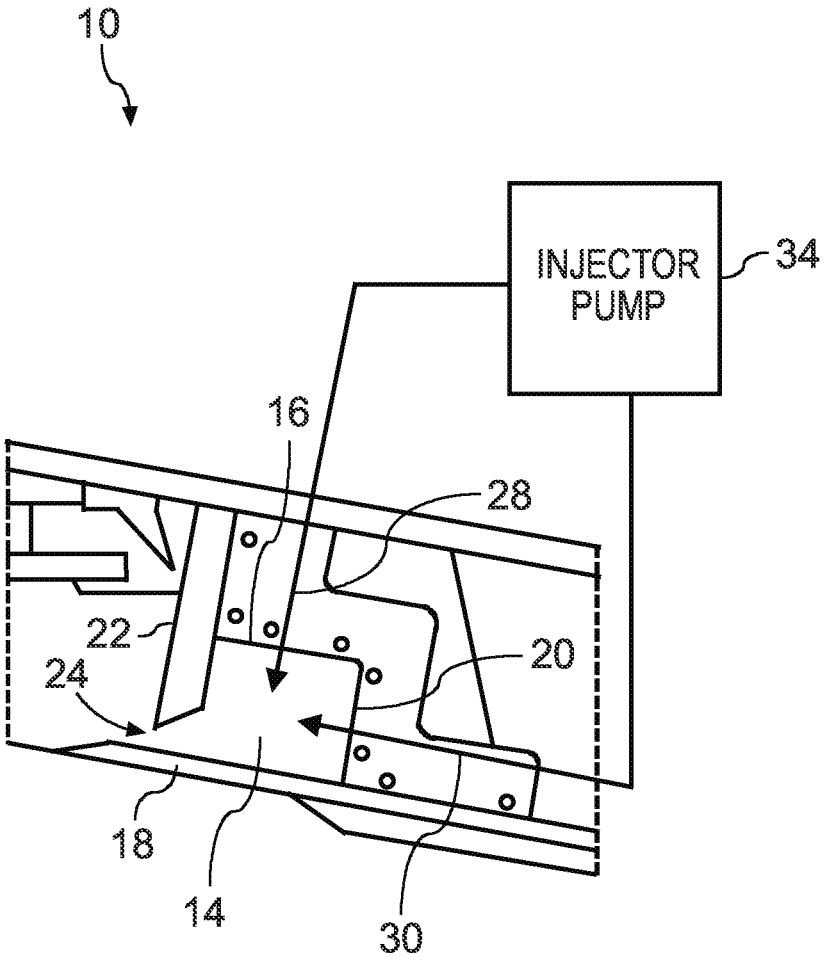
FIG. 3 is a cross-sectional view of a mixing chamber for receiving a foamed suspension of fibers in accordance with the present disclosure.

As shown in FIG. 3, the mixing chamber 14 includes a top 16 spaced from a bottom 18. The mixing chamber 14 further includes side wall 20 and a pair of opposing end walls that enclose the ends of the mixing chamber 14 along the width direction. In accordance with the present disclosure, the mixing chamber 14 further includes a front slice wall 22. The front slice wall extends from the top 16 of the mixing chamber 14 and terminates prior to the bottom 18. More particularly, the front slice wall 22 forms a narrow constriction 24 with the bottom 18 of the mixing chamber 14. The narrow constriction 24, in the embodiment illustrated, is in the shape of a slot that extends over the width of the mixing chamber 14. As will be described in greater detail below, a foamed suspension of fibers deposited or injected into the mixing chamber 14 is directed out of the mixing chamber 14 through the narrow constriction 24.

In the embodiment illustrated, the front slice wall 22 forms a narrow constriction 24 with the bottom 18 of the mixing chamber 14. It should be understood, however, that the narrow constriction 24 can be elevated in the mixing chamber 14 and located at any suitable location on the front slice wall 22. In addition, the narrow constriction can have any suitable cross-sectional shape.

The foamed suspension of fibers can be fed to the mixing chamber 14 using various techniques and processes. For example, the foamed suspension of fibers can be injected into the mixing chamber in a manner that promotes better mixing of the fibers.

In one aspect, the foamed suspension of fibers is injected into the mixing chamber 14 in at least two different directions. For example, as shown in FIG. 3, an injector pump 34 can be used to inject an aqueous suspension of fibers through one or more top nozzles 28 positioned at the top 16 of the mixing chamber 14 and through one or more side nozzles 30 positioned along the side wall 20 of the mixing chamber 14. In this manner, the foamed suspension of fibers is injected into the mixing chamber 14 from a vertical direction and from a horizontal direction. The vertical stream of fibers and the horizontal stream of fibers intersect within the mixing chamber 14 and promote robust mixing within the chamber.

The foamed suspension can enter the mixing chamber at a velocity of greater than about 1 m/sec, such as greater than about 1.5 m/sec, such as greater than about 2 m/sec, such as greater than about 2.5 m/sec, and less than about 6 m/sec, such as less than about 5 m/sec, such as less than about 4 m/sec. The mixing chamber 14 as shown in FIG. 3 represents one embodiment of a method for initially mixing the fibers within the foamed suspension. In other embodiments, however, the foamed suspension of fibers may only be injected into the mixing chamber 14 along a single direction that includes baffles or curved surfaces for promoting mixing. In still other embodiments, the foamed suspension of fibers can be injected into the mixing chamber 14 from greater than two different directions.

Once injected into the mixing chamber 14 and mixed, the foamed suspension of fibers is directed through the narrow constriction 24 formed by the front slice wall 22. As shown in FIG. 2, after exiting the narrow constriction 24, the foamed suspension of fibers enters a forming zone 60 that permits the foamed suspension of fibers to expand in volume. As shown in FIG. 2, for example, the forming zone 60 extends over the width of the nonwoven web making machine, such as a papermaking machine when containing pulp fibers, and is defined as the space between a moving forming surface 62 and a top forming surface 64. As shown in FIG. 2, the moving forming surface can be positioned at an incline to the horizontal. For example, the forming surface 62 can be at an angle of greater than about 5°, such as greater than about 10°, such as greater than about 15°, such as greater than about 20°, such as greater than about 25°, such as greater than about 300 with respect to the horizontal. The angle of the forming surface 62 is generally less than about 60°, such as less than about 50°, such as less than about 40°, such as less than about 30°. Although optional, the inclined forming surface can assist in draining the foamed suspension of fibers and can assist in forming an embryonic web 12.

As shown in FIG. 2, the forming zone formed between the moving forming surface 62 and the top forming surface 64 can have a gradually decreasing volume. The gradually decreasing volume of the forming zone 60, for instance, can help channel the foamed suspension of fibers downstream and facilitate formation of the embryonic web 12. Thus, the forming zone 60 generally has a relatively large volume adjacent the narrow constriction 24 and then gradually decreases to a smaller volume at the opposite end. Having an expansive or larger volume adjacent the narrow constriction 24 permits expansion of the foamed suspension of fibers as the foamed suspension enters the forming chamber and consequently promotes better mixing of the fibers. For example, the height of the forming chamber 60 adjacent the narrow constriction 24 can be the same height as the mixing chamber 14 or can have a height that is higher than the mixing chamber 16 as shown in FIG. 2. For example, the height of the forming chamber 60 adjacent the narrow constriction 24 can be at least about 1.3 times, such as at least about 1.5 times, such as at least about 1.8 times, such as at least about 2 times, such as at least about 2.3 times, such as at least about 2.5 times, such as at least about 2.8 times, such as at least about 3 times, such as at least about 3.5 times, such as at least about 4 times, such as at least about 4.5 times the height of the narrow constriction 24 and generally less than about 5 times the height of the narrow constriction. The height of the forming chamber 60 adjacent the narrow constriction 24 is generally not limited but for practical purposes can be about the same as the height of the mixing chamber 16.

As described above, the foamed suspension of fibers exits the mixing chamber 14 and is operatively deposited onto the moving forming surface 62. The moving forming surface 62 can be a felt, wire, or screen and is porous for allowing fluids to drain from the foamed suspension of fibers. In one embodiment, as shown in FIG. 2, one or more drain boxes can be positioned below the moving forming surface 62 for facilitating draining of the foamed suspension. In the embodiment illustrated in FIG. 2, for instance, the system includes three drain boxes 66, 68 and 70. Each drain box 66, 68 and 70 can be associated with a vacuum or suction device for applying a suction force to a foamed suspension of fibers being conveyed on the moving forming surface 62. In one aspect, for instance, a single vacuum device can be used to apply suction from each of the different drain boxes 66, 68 and 70. The vacuum device can be placed in operative association with each of the drain boxes in a manner such that the amount of suction in each drain box can be varied individually. Alternatively, each drain box 66, 68 and 70 can be associated with a separate vacuum device for controlling the amount of suction forces within each drain box. Having multiple drain boxes below the moving forming surface 62 permits controlled draining of the foamed suspension of fibers. For example, drainage over the length of the forming surface 62 can be uniform or can be varied such that there is a particular drainage profile as the embryonic web 12 is formed.

Figure 4:
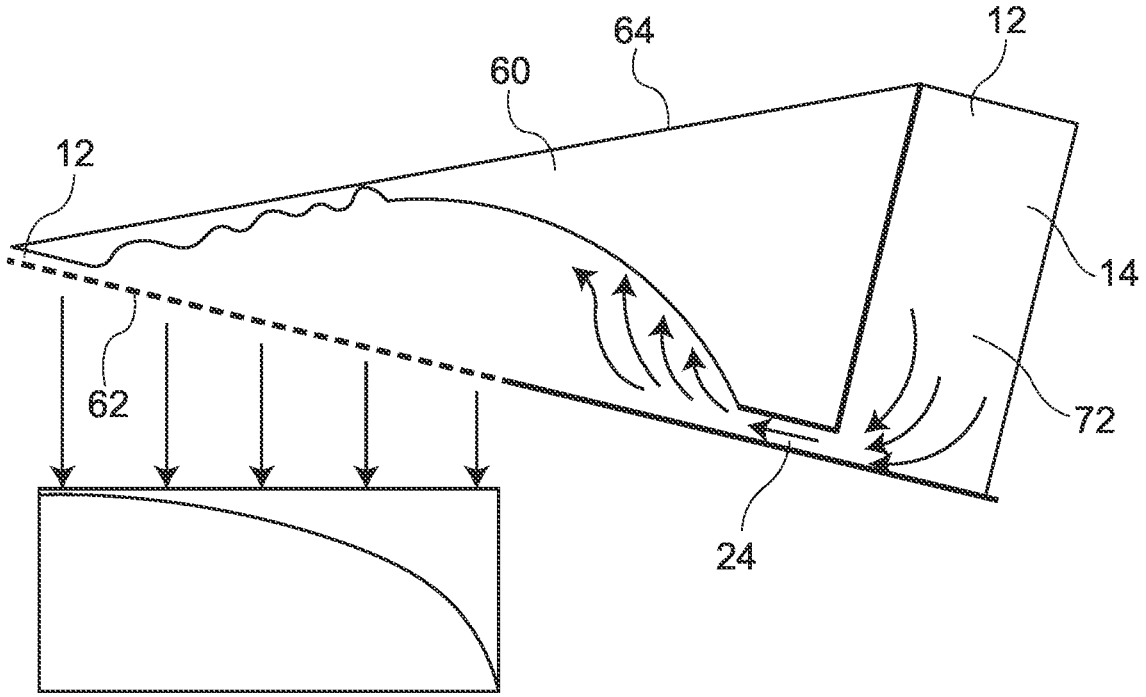
FIG. 4 is a diagram illustrating flow of a foamed suspension of fibers when using the process and system as shown in FIG. 2.
Figure 5:
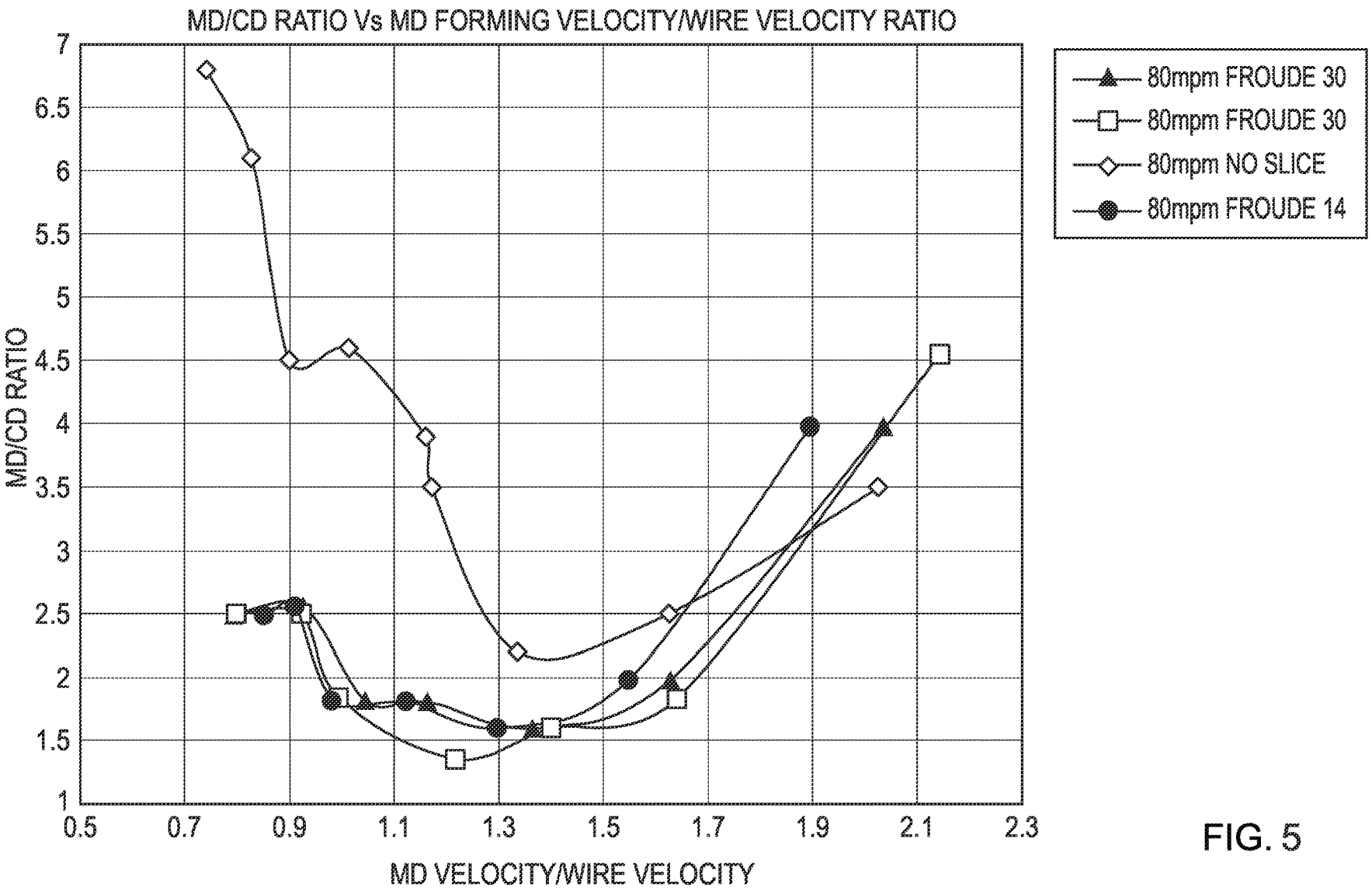
FIG. 5 is a graphical representation of some of the results discussed in the example below.

Referring now to FIG. 4, one embodiment of a flow profile and drainage profile of a foamed suspension of fibers processed according to the present disclosure is shown. As shown in FIG. 4, a foamed suspension of fibers 72 is contained in the mixing chamber 14 in a well-mixed state. From the mixing chamber 14, the foamed suspension of fibers 72 is forced through the narrow constriction 24. The narrow constriction 24 has a size that causes the foamed suspension of fibers 72 to rapidly increase in velocity and flow rate. The foamed suspension of fibers 72 then exits the narrow constriction 24 and discharges into the forming zone 60. The rapid increase in flow rate followed by a significant decrease in flow rate of the foamed suspension of fibers 72 causes significant turbulence to occur in the forming chamber 60 causing further mixing of the fibers. Through this process, the orientation of the fibers, as opposed to only being oriented in the flow direction, becomes much more random. Consequently, fiber orientation in the machine direction can be the same or similar to the fiber orientation in the cross-machine direction. As shown in FIG. 4, after exiting the narrow constriction 24, the foamed suspension of fibers 72 is then drained through the forming surface 62 for preserving and locking in the fiber orientation. In this manner, embryonic webs 12 can be produced that have physical properties in the machine direction that are very similar to physical properties in the cross-machine direction.

One method for determining whether a web has random fiber orientation as opposed to fiber orientation primarily in a single direction is to measure the tensile strength of the web in both the machine direction and the cross-machine direction and determine a ratio. A ratio of 1 indicates that fiber orientation is generally equal in both directions. Webs made according to the present disclosure, for instance, can have a machine direction to cross-machine direction tensile strength ratio of generally greater than about 0.8, such as greater than about 0.9, such as greater than about 1, such as greater than about 1.1. The machine direction to cross-machine direction tensile strength ratio of the web can generally be less than about 1.8, such as less than about 1.6, such as less than about 1.4, such as less than about 1.2. It should be understood, however, that the process and system of the present disclosure can also be used to control fiber orientation. Thus, the process and system can also be used to produce webs that have fibers oriented primarily in a single direction. Consequently, in other embodiments, the process and system of the present disclosure can be used to produce webs having a machine direction to cross-machine direction tensile strength ratio outside of the ranges described above.

As explained above, in FIG. 4, the foamed suspension of fibers 72 is first mixed in a mixing chamber, accelerated in flow rate and velocity through the narrow constriction 24 and then discharged into a forming zone 60 that has an expansive volume allowing the foamed suspension of fibers to rapidly decrease in velocity and flow rate causing turbulent flow within the fluid and resulting in random fiber orientation. Turbulent flow refers to flow of the foamed suspension in which the fluid undergoes irregular fluctuations, or mixing, in contrast to laminar flow in which the fluid moves in smooth paths or layers. In the process illustrated in FIG. 4, for instance, the foamed suspension of fibers can undergo turbulent flow within the forming chamber 60 causing fluid swirls and eddies to be created that significantly enhance random distribution of the fibers within the foam.

In one embodiment, for instance, the foamed suspension of fibers 72 undergoes a hydraulic jump from the mixing chamber 14 to the forming zone 60. A hydraulic jump, for instance, can occur when a shallow, high velocity fluid meets slower moving fluid causing a rapid dissipation of kinetic energy. For example, when a fluid at high velocity discharges into a zone of lower velocity, a rather abrupt rise can occur in the fluid surface. The rapidly flowing fluid is abruptly slowed and increases in height which releases kinetic energy resulting in turbulence and/or the formation of eddies. For example, under some conditions, the transition of the fluid from fast velocity to slow velocity causes the fluid to curl back upon itself which, in the process of the present disclosure, causes the fibers to undergo intensive mixing and reorientation.

In one embodiment, flow of the foamed suspension of fibers reaches super-critical flow within the narrow constriction 24 followed by sub-critical flow within the forming chamber 60. Super-critical flow occurs when flow is dominated by inertial forces as opposed to gravitational forces and can behave as rapid or unstable flow. Super-critical flow has a Froude number of greater than 1. Sub-critical flow, on the other hand, is dominated by gravitational forces and behaves in a slower stable way. As flow transitions from super-critical flow to sub-critical flow, a hydraulic jump can occur which represents a high energy loss, turbulent flow, and a random orientation of the fibers.

In one aspect of the present disclosure, the flow of the foamed suspension of fibers through the narrow constriction 24 can operate at a desired Froude number. For instance, the Froude number of the foamed suspension of fibers can be greater than about 2, such as greater than about 5, such as greater than about 10, such as greater than about 15, such as greater than about 20, such as greater than about 25, such as greater than about 30, and generally less than about 50, such as less than about 40.

Once the foamed suspension of fibers 72 has been discharged into the forming zone 60 and undergone fiber reorientation, the foamed suspension of fibers is drained from fluids in an effort to keep intact and lock in the fiber orientation within the resulting web. Two factors that can affect fiber orientation include the relative velocity of the forming surface 62 in relation to the velocity of the foamed suspension of fibers in the machine direction and the drainage profile of the foamed suspension.

For example, in one aspect, the velocity of the moving forming surface 62 is controlled so as to prevent the fibers contained within the foamed suspension from reorienting into a primarily machine direction orientation. In this regard, the speed of the moving forming surface 62 can be matched with the speed at which the foamed suspension of fibers is flowing in the machine direction through the forming zone 60. In one aspect, for example, the foamed suspension of fibers moves at a velocity in a machine direction in the forming zone and the forming surface moves at a velocity and wherein a ratio of the foamed suspension of fibers velocity to the forming surface velocity during draining of the foamed suspension of fibers is from about 1:0.5 to about 1:2, such as from about 1:0.8 to about 1:1.8.

In addition to the velocity of the forming surface 62, the drainage profile of the foamed suspension of fibers can also be controlled in order to maintain the desired fiber orientation. For example, the forming zone can have a length and wherein the foamed suspension of fibers has a drainage profile over the length of the forming zone such that drainage is substantially the same from the beginning of the forming zone to an end of the forming zone. For example, in one embodiment, the drainage profile does not change by more than about 20%, such as by no more than about 10% over the length of the forming zone in terms of either volume of fluid drained or weight of fluid drained.

Alternatively, as shown in FIG. 4, the system can be designed so that greater drainage of the fluids occurs at the beginning of the forming surface and then gradually decreases towards the end of the forming surface. For example, as shown in FIG. 2, drain boxes 66, 68 and 70 can be used to produce any desired drainage profile. In one embodiment, for example, the drainage profile over the length of the forming zone is such that greater than about 50%, such as greater than about 55%, such as greater than about 60%, such as greater than about 65%, such as even greater than about 70% of fluid drainage occurs over an initial 33% of the length of the forming zone.

Once the foamed suspension of fibers is formed into a web, the web may be processed using various techniques and methods. For example, in FIG. 1, a method is shown for making throughdried nonwoven webs and is shown for exemplary purposes only. (For simplicity, the various tensioning rolls schematically used to define the several fabric runs are shown, but not numbered. It will be appreciated that variations from the apparatus and method illustrated in FIG. 1 can be made without departing from the general process).

The wet web is transferred from the fabric 26 to a transfer fabric 40. In one embodiment, the transfer fabric can be traveling at a slower speed than the forming fabric in order to impart increased stretch into the web. This is commonly referred to as a "rush" transfer. The transfer fabric can have a void volume that is equal to or less than that of the forming fabric. The relative speed difference between the two fabrics can be from 0-60 percent, more specifically from about 15-45 percent. Transfer can be carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and appearance if desired. Suitable throughdrying fabrics are described in U.S. Pat. No. 5,429,686 issued to Kai F. Chiu et al. and U.S. Pat. No. 5,672,248 to Wendt, et al. which are incorporated by reference.

In one embodiment, the throughdrying fabric contains high and long impression knuckles. For example, the throughdrying fabric can have about from about 5 to about 300 impression knuckles per square inch which are raised at least about 0.005 inches above the plane of the fabric. During drying, the web can be further macroscopically arranged to conform to the surface of the throughdrying fabric and form a three-dimensional surface. Flat surfaces, however, can also be used in the present disclosure.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web is typically smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is finally dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

In one embodiment, the resulting web 52 can be a textured web which has been dried in a three-dimensional state such that the hydrogen bonds joining cellulose fibers (when present) were substantially formed while the web was not in a flat, planar state. For example, the web 52 can be dried while still including a pattern formed into the web by the gas conveying device 30 and/or can include a texture imparted by the through-air dryer.

In general, any process capable of forming a web can also be utilized in the present disclosure. For example, a process of the present disclosure can utilize creping, double creping, embossing, air pressing, creped through-air drying, uncreped through-air drying, coform, hydroentangling, thermal bonding, as well as other steps known in the art. For example, in one embodiment, the web can be subjected to a hydroentangling step during the process. Further, instead of throughair drying, the web can be dried using any suitable drying device, such as one or more heated drying rollers.

The basis weight of webs made in accordance with the present disclosure can vary depending upon the final product. For example, the process may be used to produce bath tissues, facial tissues, paper towels, industrial wipers, and the like. Various other products can be made in accordance with the present disclosure. For instance, the process and system can also be used to produce all different types of nonwoven webs, such as webs that may be incorporated into absorbent articles. In one aspect, webs can be produced that contain substantial amounts of synthetic polymer fibers. For instance, the webs can contain synthetic polymer fibers in amounts greater than about 20% by weight, such as in amounts greater than about 30% by weight, such as in amounts greater than about 40% by weight, such as in amounts greater than about 50% by weight. In general, the basis weight of the products may vary from about 6 gsm to about 800 gsm, such as from about 10 gsm to about 200 gsm. For bath tissue and facial tissues, for instance, the basis weight may range from about 10 gsm to about 40 gsm. For paper towels, on the other hand, the basis weight may range from about 25 gsm to about 90 gsm. For wipers the basis weight may range from about 40 gsm to about 125 gsm.

The web bulk may also vary from about 3 cc/g to 20 cc/g, such as from about 5 cc/g to 15 cc/g. The sheet "bulk" is calculated as the quotient of the caliper of a dry sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In alternative embodiments, lower bulk products can be formed. For instance, the webs can have a bulk of less than 3 cc/g, such as less than 2 cc/g, such as less than 1 cc/g.

In multiple ply products, the basis weight of each web present in the product can also vary. In general, the total basis weight of a multiple ply product will generally be the same as indicated above, such as from about 15 gsm to about 120 gsm. Thus, the basis weight of each ply can be from about 10 gsm to about 60 gsm, such as from about 20 gsm to about 40 gsm.

The present disclosure may be better understood with reference to the following example.

Example

A process similar to that shown in FIG. 2 was used to produce various foam formed webs. Each of the webs contained 70% by weight softwood fibers and 30% by weight 12 mm, 0.5 denier polyester fibers. The fibers were combined with water and a surfactant and formed into a foam containing 40 to 60% air. The velocity of the forming surface through the system was 80 meters per minute. The height of the narrow constriction was varied to change the Froude number of the flow of the foamed suspension of fibers. In Sample Nos. 1 and 2, the Froude number was 30. In Sample No. 4, the Froude number was 14. A further experiment was run without using a front slice wall (Sample No. 3).

During the set of experiments, the velocity ratio between the velocity of the foamed suspension of fibers and the forming surface velocity was varied. Samples made were then tested for the machine direction to cross-machine direction tensile strength ratio (md/cd). The results are below and shown in FIG. 4.

| Velocity ratio | md/cd |
|---|---|
| Sample No. 1 Froude 30 | |
| 2.04 | 3.98 |
| 1.63 | 1.98 |
| 1.36 | 1.60 |
| 1.16 | 1.81 |
| 1.04 | 1.82 |
| 0.93 | 2.56 |
| 0.79 | 2.49 |
| Sample No. 2 Froude 30 | |
| 2.14 | 4.55 |
| 1.64 | 1.83 |
| 1.40 | 1.60 |
| 1.22 | 1.35 |
| 0.99 | 1.84 |
| 0.92 | 2.50 |
| 0.80 | 2.50 |
| Sample No. 3 No Slice | |
| 2.03 | 3.50 |
| 1.63 | 2.50 |
| 1.34 | 2.20 |
| 1.17 | 3.50 |
| 1.16 | 3.90 |
| 1.01 | 4.60 |
| 0.90 | 4.50 |
| 0.83 | 6.10 |
| 0.74 | 6.80 |
| Sample No. 4 Froude 14 | |
| 1.89 | 3.98 |
| 1.55 | 1.98 |
| 1.30 | 1.60 |
| 1.12 | 1.81 |
| 0.98 | 1.82 |
| 0.91 | 2.56 |
| 0.85 | 2.49 |

As shown in FIG. 4, using the configuration illustrated in FIG. 2 leads to not only dramatically improved md/cd ratios but also unexpectedly produces a much larger operating window for optimizing fiber orientation.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A process for producing a web comprising:

depositing a foamed suspension of fibers into a mixing chamber, the mixing chamber including a top, a bottom, and at least one sidewall, the mixing chamber having a height and a width, the mixing chamber further comprising a front slice wall that terminates a distance from the bottom of the mixing chamber forming a narrow constriction;

flowing the foamed suspension of fibers from the mixing chamber through the narrow constriction and into a forming zone, the foamed suspension being conveyed on a moving forming surface, the foamed suspension of fibers having a fluid flow rate and the narrow constriction having a size such that the foamed suspension of fibers undergoes fiber mixing within the forming zone;

draining fluids from the foamed suspension of fibers through the forming surface within the forming zone to form an embryonic web; and drying the embryonic web.

2. A process as defined in claim 1, wherein the height extends from the top to the bottom, the mixing chamber being enclosed except for the narrow constriction, the narrow constriction comprising a slot that extends along the width of the mixing chamber.

3. A process as defined in claim 1, wherein the foamed suspension of fibers undergoes super-critical flow in the narrow constriction.

4. A process as defined in claim 1, wherein the foamed suspension of fibers moves at a velocity in a machine direction in the forming zone and the forming surface moves at a velocity, and wherein a ratio of the foamed suspension of fibers velocity to the forming surface velocity during draining of the foamed suspension of fibers is from about 1:0.5 to about 1:2.

5. A process as defined in claim 1, wherein the forming zone has a length and wherein the foamed suspension of fibers has a drainage profile over the length of the forming zone, and wherein greater than about 50% of drainage occurs over an initial 33% of the length of the forming zone.

6. A process as defined in claim 1, wherein the dried web has a machine direction to cross-machine direction tensile strength ratio of from about 0.8 to about 1.8.

7. A process as defined in claim 1, wherein a turbulent flow of the foamed suspension of fibers within the forming zone produces eddies that causes changes in the orientation of the fibers in the foamed suspension.

8. A process as defined in claim 1, wherein the forming surface is inclined in relation to a horizontal.

9. A process as defined in claim 1, wherein the foamed suspension of fibers is formed by combining a foam with a fiber furnish, the foam having a density of from about 200 g/L to about 600 g/L.

10. A process as defined in claim 1, wherein the foamed suspension is formed by combining a foaming agent with water, the foamed fiber suspension in the mixing chamber containing from about 40% to about 65% by volume air.

11. A process as defined in claim 10, wherein the foaming agent comprises sodium lauryl sulfate.

12. A process as defined in claim 1, wherein the fibers contained in the web comprise at least about 50% by weight pulp fibers.

13. A process as defined in claim 1, wherein the fibers contained in the web comprise at least about 5% by weight synthetic fibers.

14. A process as defined in claim 1, wherein the web is dried by through-air drying.

15. A process as defined in claim 1, wherein the dried web has a bulk of greater than about 3 cc/g.

16. A process as defined in claim 1, wherein the dried web has a bulk of less than about 3 cc/g.

17. A process as defined in claim 1, wherein the dried web has a basis weight of from about 6 gsm to about 800 gsm.

18. A process as defined in claim 1, wherein the foamed suspension of fibers is injected into the mixing chamber at a velocity of greater than about 1 m/sec.

19. A system for producing webs comprising:

an enclosed mixing chamber for receiving a foamed suspension of fibers, the enclosed mixing chamber including a top, a bottom, and at least one sidewall, the mixing chamber having a height and a width, the mixing chamber further comprising a front slice wall that terminates a distance from the bottom of the mixing chamber forming a narrow constriction, wherein a foamed suspension of fibers deposited into the mixing chamber is directed out of the mixing chamber through the narrow constriction;

a moving forming surface in operative engagement with the mixing chamber, the forming surface moving in a machine direction and receiving the foamed suspension of fibers for conveying the foamed suspension of fibers downstream;

a forming zone positioned adjacent to the narrow constriction of the mixing chamber, the forming zone having a length and being defined by the moving forming surface and a top forming surface, the top forming surface being spaced from the moving forming surface; and a drying device positioned downstream from the forming zone for drying a web formed in the forming zone.

20. A system as defined in claim 19, wherein the forming zone has a gradually decreasing height in the machine direction over the length of the forming zone.

21. A system as defined in claim 19, wherein the moving forming surface is inclined in relation to a horizontal.

22. A headbox comprising:

an enclosed mixing chamber for receiving a foamed suspension of fibers, the enclosed mixing chamber including a top, a bottom, and at least one sidewall, the mixing chamber having a height and a width, the mixing chamber further comprising a front slice wall that terminates a distance from the bottom of the mixing chamber forming a narrow constriction, wherein a foamed suspension of fibers deposited into the mixing chamber is directed out of the mixing chamber through the narrow constriction; and a forming zone positioned adjacent to the narrow constriction of the mixing chamber, the forming zone having a length and a top forming surface, the forming zone having a decreasing height along the length of the forming zone from the narrow constriction.

* * * * *